US012716135B2

(12) United States Patent
Jiang et al.

(10) Patent No.: US 12,716,135 B2
(45) Date of Patent: Aug. 25, 2026

(54) PUMP FREE ALKALINE ELECTROLYTE MEMBRANE WATER ELECTROLYTIC DEVICE

(71) Applicant: U.S. Army DEVCOM, Army Research Laboratory, Adelphi, MD (US)

(72) Inventors: Rongzhong Jiang, Olney, MD (US); Jiangtian Li, Ellicott City, MD (US); Deryn D. Chu, Potomac, MD (US); David R. Baker, Silver Spring, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 129 days.

(21) Appl. No.: 17/947,797

(22) Filed: Sep. 19, 2022

(65) Prior Publication Data

US 2024/0093387 A1 Mar. 21, 2024

(51) Int. Cl.
*C25B 9/21* (2021.01)
*C25B 1/04* (2021.01)
(Continued)

(52) U.S. Cl.
CPC ..... *C25B 9/21* (2021.01); *C25B 1/04* (2013.01); *C25B 11/063* (2021.01);
(Continued)

(58) Field of Classification Search
CPC ... C25B 1/04; C25B 9/23; C25B 11/031–032; H01M 4/861; H01M 4/8636
See application file for complete search history.

(56) References Cited

U.S. PATENT DOCUMENTS 3,567,520 A * 3/1971 Dennery ..... H01M 8/0245 34/284
4,804,592 A * 2/1989 Vanderborgh ..... C25B 11/00 429/492

(Continued)

OTHER PUBLICATIONS

Lin et al, "In Situ Probe of the Hydrogen Oxidation Reaction Intermediates on PtRu a Bimetallic Catalyst Surface by Core-Shell Nanoparticle-Enhanced Raman Spectroscopy", Nano Lett. 2022, 22, 5544-5552 (Year: 2022).*

(Continued)

*Primary Examiner* — Luan V Van
*Assistant Examiner* — Andrew Koltonow
(74) *Attorney, Agent, or Firm* — Eric B. Compton

(57) ABSTRACT

An alkaline electrolyte membrane (AEM) electrolytic device is designed, assembled and evaluated for water electrolysis, composed of an anode for oxygen generation, a cathode for hydrogen generation, an AEM for anion conductive, and two internal water gas separators (IWGSs) for water supplying to the anode and the cathode, respectively, as well as for automatically separation of water and gas produced from the anode or from the cathode. There is no need of pumps for water and gas circulations and no external water gas separators (EWGSs) that are used by conventional water electrolyzers. The corrosive electrolyte is confined in the water containers and will not damage other parts in the electrolytic device. Furthermore, novel multi gas diffusion layers are used to replace the conventional single gas diffusion layer. The pore size is configurable to improve the mass transfer of electrochemical reactions and promote electrochemical reactions.

27 Claims, 13 Drawing Sheets

(51) Int. Cl.

| | |
|---|---|
| ***C25B 11/063*** | (2021.01) |
| ***C25B 11/093*** | (2021.01) |
| ***C25B 13/02*** | (2006.01) |
| ***C25B 13/05*** | (2021.01) |

(52) U.S. Cl.
CPC ..... *C25B 11/093* (2021.01); *C25B 13/02* (2013.01); *C25B 13/05* (2021.01)

(56) References Cited

U.S. PATENT DOCUMENTS

| | | | | |
|---|---|---|---|---|
| 6,375,812 | B1 * | 4/2002 | Leonida | C25B 1/04 204/269 |
| 6,685,821 | B2 | 2/2004 | Kosek | |
| 8,282,811 | B2 | 10/2012 | Kosek | |
| 9,692,070 | B2 * | 6/2017 | Lee | D21H 13/12 |
| 10,883,181 | B2 | 1/2021 | Takanami | |
| 11,008,661 | B2 | 5/2021 | Frimann | |
| 11,105,003 | B2 | 8/2021 | Lin | |
| 2004/0038808 | A1 * | 2/2004 | Hampden-Smith | H01M 4/8828 429/479 |
| 2013/0337366 | A1 * | 12/2013 | Blanchet | H01M 8/04201 156/196 |
| 2015/0207163 | A1 * | 7/2015 | Jiang | H01M 8/0245 429/480 |
| 2016/0010220 | A1 * | 1/2016 | Bower | C25B 15/08 205/628 |
| 2016/0060776 | A1 * | 3/2016 | Kawajiri | C25B 9/00 205/637 |
| 2019/0264341 | A1 * | 8/2019 | Bahar | C25B 9/73 |
| 2020/0370188 | A1 * | 11/2020 | Oener | C25B 13/08 |

OTHER PUBLICATIONS

Grigoriev, S.A., et al., "Current status, research trends, and challenges in water electrolysis science and technology", Int'l J. Hydrogen Energy, 45 (2020) 26036-26058.

Y. Zhang et al., "Bubble transport characteristic on hydrogen evolution reaction of aligned porous electrode," Journal of Power Sources 614 (2024) 235029.

* cited by examiner

PUMP FREE ALKALINE ELECTROLYTE MEMBRANE WATER ELECTROLYTIC DEVICE

GOVERNMENT INTEREST

The invention described herein may be manufactured and used by or for the Government of the United States for all governmental purposes without the payment of any royalty.

TECHNICAL FIELD

Embodiments of the present disclosure are drawn to an electrochemical device, and more particularly to a water electrolytic device for, e.g., hydrogen generation.

BACKGROUND

Solar energy is considered as a clean and infinite energy to replace fossil fuels that cause greenhouse effect. There is a great challenge to convert and store solar energy generated from a solar panel. The use of rechargeable batteries to store solar energy is not satisfactory, as a limitation of small capacity in a battery.

One solution is to provide storage via by water electrolysis for hydrogen generation, which is later converted to electricity via a fuel cell at any time electric power is needed. A water electrolytic device (or "electrolyzer") is an electrochemical apparatus for hydrogen generation through electrochemical reactions. However, even conventional techniques have been insufficient to date.

Currently, the commercial methods of water electrolysis for hydrogen generation are based on an acidic system, which must use noble metal catalyst. The only existing electrochemically stable catalyst in acidic environmental for water electrolysis is Iridium oxides ($IrO_2$).

Additionally, such systems require water to be supplied to the electrolyzer. This typically requires pumps to supply and circulate water and electrolyte. Furthermore, the products of water electrolysis are mixtures of water/electrolyte/hydrogen and water/electrolyte/oxygen. Conventionally, external water/gas separators are used to separate gases and recycle water, and pumps to circulate water/electrolyte. Unfortunately, for alkaline electrolyte membrane electrolyzers, the water contains corrosive electrolyte, such as potassium hydroxide (KOH). The KOH is harmful to apparatuses, such as the pumps, containers and tubes for water gas separator, and circulation.

Thus, devices, systems, and methods that avoid the above-described problems are useful and desirable.

BRIEF SUMMARY

A water electrolytic device may be provided. The water electrolytic device may include two internal water-gas separators sandwiching a membrane electrode assembly (MEA). In some embodiments, the water electrolytic device may include a first internal water-gas separator having walls defining a first internal volume of space configured to be partially filled with a first liquid. In some embodiments, the water electrolytic device may include a second internal water-gas separator having walls defining a second internal volume of space configured to be partially filled with a second liquid. In some embodiments, the water electrolytic device may include at least one membrane electrode assembly (MEA). Each MEA may include multiple layers. The multiple layers may include a first current collector having a first surface defining a first plurality of openings extending from the first surface to a second surface opposite the first surface. The multiple layers may include a first outer gas diffusion layer coupled to the first current collector. The multiple layers may include a first inner gas diffusion layer coupled to the first outer gas diffusion layer. The multiple layers may include an anode catalyst layer coupled to the first inner gas diffusion layer, the anode catalyst layer comprising an anode catalyst. The multiple layers may include an alkaline electrolyte membrane (AEM) coupled to the anode catalyst layer. The multiple layers may include a cathode catalyst layer coupled to the AEM. The multiple layers may include a second inner gas diffusion layer coupled to the cathode catalyst layer, the cathode catalyst layer comprising a cathode catalyst. The multiple layers may include a second outer gas diffusion layer coupled to the second inner gas diffusion layer. The multiple layers may include a second current collector coupled to the second outer gas diffusion layer, the second current collector having a first surface defining a second plurality of openings extending from the first surface to a second surface opposite the first surface. The first current collector of a first MEA may be coupled to the first internal water-gas separator, and the second current collector of the first MEA may be coupled to the second internal water-gas separator.

In some embodiments, the first internal volume of space may be 20-40% full of the first liquid, and the second internal volume of space may be 40-60% full of the second liquid. In some embodiments, each inner gas diffusion layer has a pore size of 10-60 μm, and each outer gas diffusion layer has a pore size of 300-600 μm. In some embodiments, the current collector may include a non-corrosive metal sheet (which may be, e.g., titanium) having a thickness of 0.6-1.0 mm.

In some embodiments, the first plurality of openings and the second plurality of openings each comprising a plurality of openings having a first diameter and a plurality of openings having a second diameter, where the second diameter is larger than the first diameter. In some embodiments, the second diameter is at least twice as large as the first diameter, such as a first diameter of 1.6 mm and a second diameter of 3.3 mm.

In some embodiments, the inner gas diffusion layer has a first mean pore size, and the outer gas diffusion layer has a second mean pore size, wherein the second mean pore size is larger than the first mean pore size, and second mean pore size is smaller than the first diameter.

In some embodiments, the water electrolytic device may include one or more intermediate gas diffusion layers between the inner gas diffusion layer and the outer gas diffusion layer, each intermediate gas diffusion layer have a first side facing the inner gas diffusion layer and a second surface facing the outer gas diffusion layer, each intermediate gas diffusion layer having a pore size larger than a pore size of an adjacent diffusion layer coupled to the first surface, and smaller than a pore size of an adjacent diffusion layer coupled to the second surface.

In some embodiments, the first liquid comprises water, an electrolyte, or both, and the second liquid comprises water, an electrolyte, or both. In some embodiments, the first liquid and the second liquid are the same.

In some embodiments, both the cathode catalyst and the anode catalyst comprise non-noble metal catalysts. In some embodiments, the cathode catalyst is different from the anode catalyst. In some embodiments, the cathode catalyst is the same as the anode catalyst. In some embodiments, the cathode catalyst and the anode catalyst comprise a PtRuOx core shell catalyst (which is active and stable in both anodic and cathodic conditions), containing a PtRu core and their oxide shell.

In some embodiments, the first internal water-gas separator comprises at least two ports coupled to the first internal volume of space, and the second internal water-gas separator comprises at least two ports coupled to the second internal volume of space. In some embodiments, the device may include at least four tubes, each tube extending through one of the ports. In some embodiments, one tube in each separator is configured to allow the liquid to be provided to the separator (and may, e.g., extend to the bottom of the internal volume of space), while a second tube in each separator is configured to allow a gas present in the headspace of the first internal volume to exit the separator without removing any liquid.

In some embodiments, each inner gas diffusion layer may include hydrophobic carbon paper or hydrophobic carbon cloth, and each inner gas diffusion layer may have a first interface for coupling to the AEM, wherein the first interface is coated with the anode catalyst layer or the cathode catalyst layer. In some embodiments, each inner gas diffusion layer may have a second interface for coupling to the outer gas diffusion layer or an intermediate gas diffusion layer, the interface being configured to allow for gas transport and electronic conductivity for electronic transfer.

In some embodiments, each outer gas diffusion layer and any intermediate gas diffusion layers are made of porous metal or porous alloy that are configured to provide electronic conductivity for promoting electronic transfer. In some embodiments, each outer gas diffusion layer and any intermediate gas diffusion layer are treated with a fluoropolymer to enhance gas transport by converting a hydrophilic property of the porous metal or porous alloy to a hydrophobic property.

In some embodiments, the water electrolytic device may include additional MEAs. In some embodiments, the water electrolytic device may include a second MEA, where the second current collector of the second MEA may be coupled to the second internal water-gas separator, and where a third internal water-gas separator may be coupled to the first current collector of the second MEA. In some embodiments, the first and second MEA are configured to be wired in parallel. In some embodiments, the first and second MEA are configured to be wired in series.

In some embodiments, a system may be provided. The system may include a water electrolytic device as disclosed herein, and a remote device configured to receive hydrogen from the water electrolytic device. In some embodiments, the remote device may be a fuel cell or a storage container.

DETAILED DESCRIPTION

Disclosed is an electrolytic device and system capable of eliminating the use of pumps, external water-gas separators, and greatly simplifying the auxiliary components required for operation.

The present disclosure is related to water electrolytic device with alkaline electrolyte membrane (AEM), which uses non-noble metal catalyst for hydrogen generation. In alkaline environmental conditions, the electrochemical reactions of water electrolysis are:

At the cathode: $4H_2O+4e^- \rightarrow 2H_2+4OH^-$.

At the anode: $4OH^- \rightarrow O_2+2H_2O+4e^-$.

The overall reaction is $2H_2O \rightarrow 2H_2+O_2$.

In some embodiments, the disclosed electrolytic device improves hydrogen generation by significantly reducing the number of parts required to do so and simplifies the complex structures of conventional systems and devices. In some embodiments, the disclosed electrolytic device realizes fast gas transport and electrochemical reactions. By providing a gradient of pore sizes in the diffusion layers, to optimize the gas bubble forming and growing process, as gas bubbles inflate from small to large size, and allow the large gas bubbles to release through openings in the current collector.

As used herein, the term "pore size" refers to a mean cross-sectional diameter of each pore, or an equivalent measurement for non-circular pores, as is known in the art.

In some embodiments, the disclosed electrolytic device allows for improved production, by allowing for simplified expansion to add additional cells.

One goal of the present disclosure is to simplify water electrolytic systems by getting rid of external water/gas separators and circulation pumps.

Figure 1A:
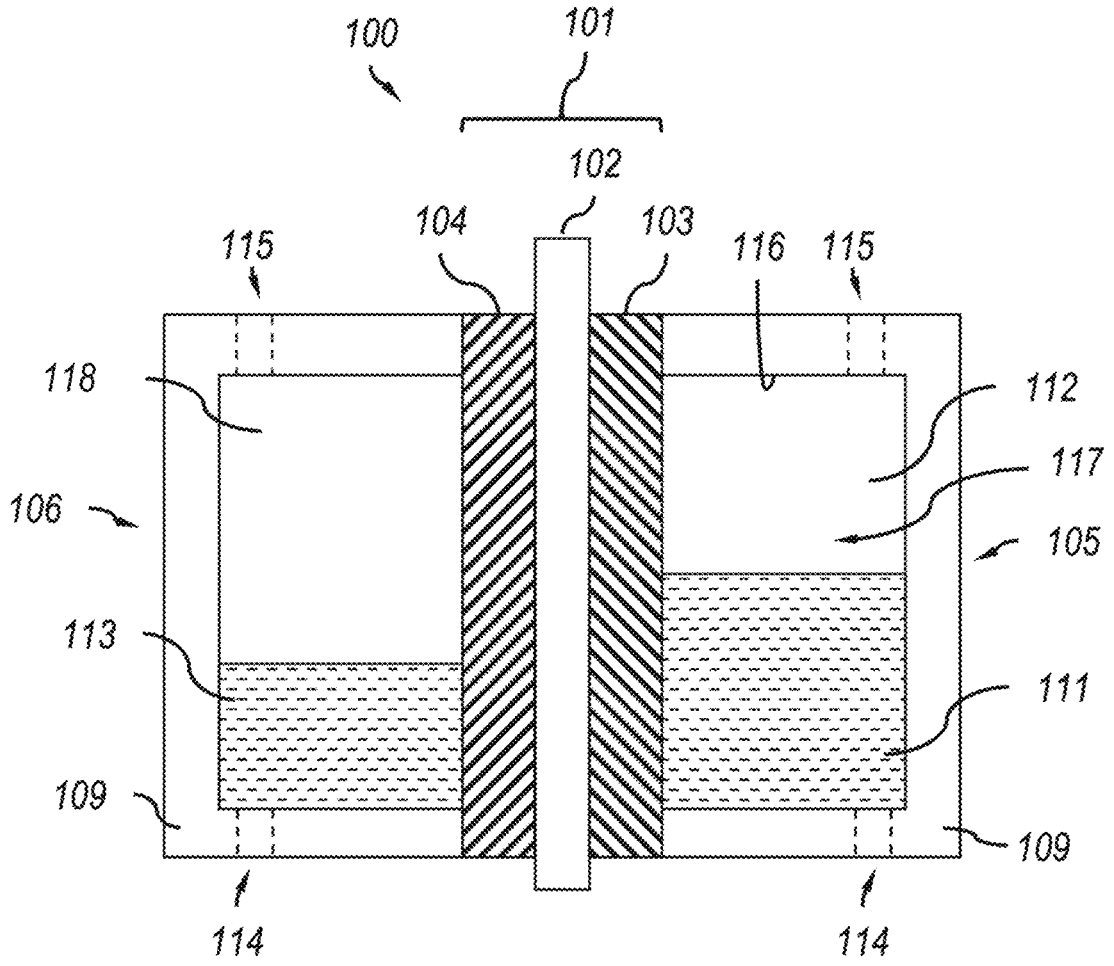
FIGS. 1A and 1B are cross-sectional illustrations of water electrolytic devices.

Referring to FIG. 1A, a water electrolytic device 100 is shown. The water electrolytic device may include at least one membrane electrode assembly (MEA) 101 sandwiched between two internal water-gas separators 105, 106. Each MEA may include an alkaline electrolyte membrane (AEM) 102 sandwiched between an anode portion 103 and a cathode portion 104. The anode portion and cathode portion may each include multiple layers.

Figure 2A:
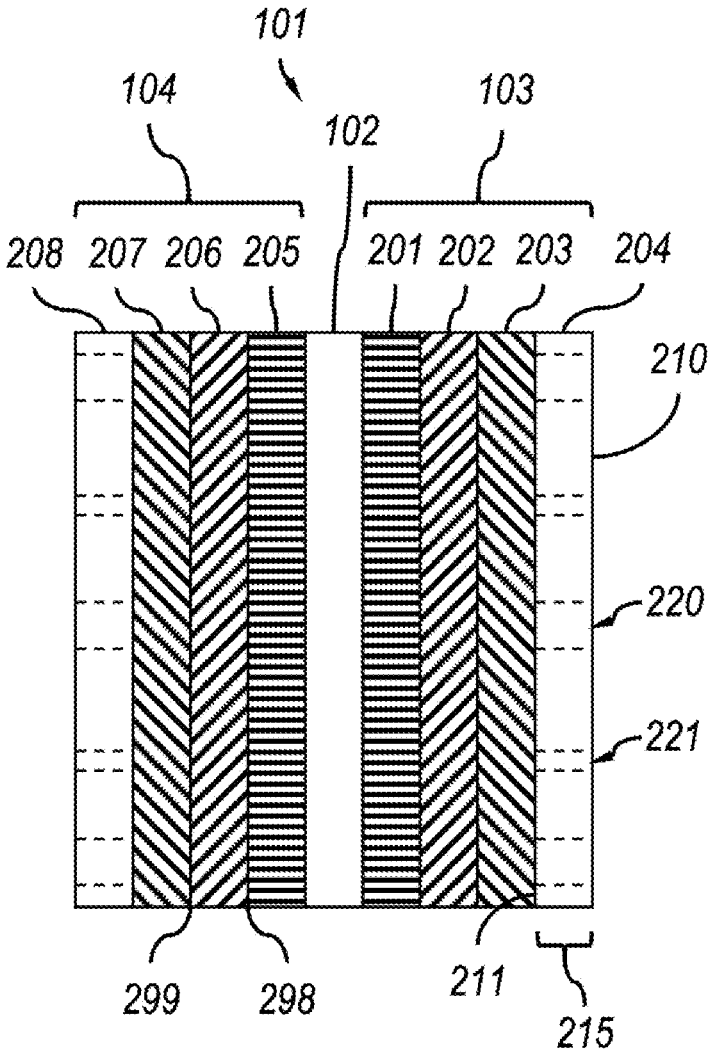
FIGS. 2A and 2B are cross-sectional illustrations of membrane electrode assemblies.

Referring to FIG. 2A, these multiple layers may be seen. Each layer may have a thickness 215. In some embodiments, each type of layer (e.g., inner gas diffusion layer, outer gas diffusion layer, current collector) may have the same thickness. In some embodiments, each type of layer may have different thicknesses.

Moving from right to left, the anode portion 103 of each MEA 101 may include a first current collector 204 having a first surface 210 defining a first plurality of openings 220, 221 extending from the first surface to a second surface 211 opposite the first surface.

In some embodiments, the current collector may include a non-corrosive metal sheet. The current collector should be comprised of a material that is stable when in contact with the first liquid, which may include a caustic electrolyte. Non-limiting examples include titanium, graphite, and steel (such as stainless steel). In some embodiments, the current collector may comprise a corrosion-resistant treatment or coating. In some embodiments, the corrosion-resistant treatment or coating comprises a fluoropolymer.

The first plurality of openings may include a plurality of openings 221 with a first diameter, and a plurality of openings 220 with a second diameter, where the second diameter is larger than the first diameter. In some embodiments, the second opening is at least twice as large as the first diameter. In some embodiments, the first diameter is less than 2 mm and the second diameter is greater than 3 mm. In some embodiments, the first diameter is 1.6 mm, and the second diameter is 3.3 mm.

In some embodiments, the current collector has a thickness of less than 1 mm. In some embodiments, the current collector has a thickness of 0.1-0.9 mm. In some embodiments, the current collector has a thickness of 0.3-0.7 mm. In some embodiments, the current collector has a thickness of 0.5-0.6 mm.

Referring to FIG. 2A, the anode portion 103 of each MEA may include a first outer gas diffusion layer 203 coupled to the first current collector.

In some embodiments, the outer gas diffusion layer is configured to be electrically conductive that is inert when exposed to the water/electrolyte. In some embodiments, the outer gas diffusion layer comprises a metal foam. As used herein, the term "metal foam" refers generally to an open cell, porous metallic structure. The metallic portion of the metal foam, for example, may be in the form of a connected lattice of metal, wherein the metal may define boundaries of cells, with interiors of the cells being voids, the voids defining pores in the metal foam.

In some embodiments, the metal foam is free of a noble metal. In some embodiments, the metal foam is a nickel foam.

In some embodiments, the outer gas diffusion layer may comprise a corrosion-resistant treatment or coating. In some embodiments, the corrosion-resistant treatment or coating comprises a fluoropolymer. In addition, the fluoropolymer coating will convert metal foam material from hydrophilic property to hydrophobic property, which enhances gas transport. Preferably, the outer gas diffusion layer exhibits hydrophobic properties to promote gas transport.

Furthermore, the outer gas diffusion layer plays an important role in electron-transfer between inner gas diffusion layer and current collector. It does so by being configured to provide excellent electronic conductivity, and have good contact with both the current collector and the inner gas diffusion layer (or intermediate layers that are electronically coupled to the inner gas diffusion layer).

The pore size of each outer gas diffusion layer should be smaller than the diameter of the openings in the current collector. In some embodiments, each outer gas diffusion layer has a pore size of 300 μm-600 μm.

In some embodiments, each outer gas diffusion layer has a thickness of 1 mm or less. In some embodiments, the outer gas diffusion layer has a thickness of 0.1-0.9 mm. In some embodiments, the outer gas diffusion layer has a thickness of 0.3-0.7 mm. In some embodiments, the current collector has a thickness of 0.3-0.4 mm.

Referring to FIG. 2A, the anode portion 103 of each MEA may include a first inner gas diffusion layer 202 coupled to the first outer gas diffusion layer.

The pore size of each inner gas diffusion layer should be smaller than the pore size of each outer gas diffusion layer. In some embodiments, each inner gas diffusion layer has a pore size of 10-60 μm.

In some embodiments, the inner gas diffusion layer may be electrically conductive. Non-limiting examples of materials used for this layer include wet-proof Toray carbon paper or wet-proof carbon cloth, etc. Foams at a different density than the outer gas diffusion layer could also be utilized.

In some embodiments, the outer gas diffusion layer has an electrical conductivity (e.g., measured in S/m) that is greater than the electrical conductivity of the inner gas diffusional layer. In some embodiments, the outer gas diffusion layer may have an electrical conductivity greater than $1\times10^6$ S/m, and the inner gas diffusion layer may have an electrical conductivity less than $1\times10^6$ S/m. In some embodiments, the outer gas diffusion layer may have an electrical conductivity greater than $1\times10^6$ S/m and less than $1\times10^8$ S/m. In some embodiments, the inner gas diffusion layer may have an electrical conductivity of $1\text{-}5\times10^5$ S/m. In some embodiments, the inner gas diffusion layer may have an electrical conductivity of $1\text{-}5\times10^2$ S/m. In some embodiments, the outer gas diffusion layer has an electrical conductivity that is 5-500,000 times the electrical conductivity of the inner gas diffusional layer. For materials such as carbon/graphite, the electrical conductivity perpendicular to the basal plane may be used.

In some embodiments, the inner gas diffusion layer may comprise a corrosion-resistant treatment or coating. In some embodiments, the corrosion-resistant treatment or coating comprises a fluoropolymer. In addition, the fluoropolymer will add a "wet-proof" (or hydrophilic) property for enhancing gas transport.

In some embodiments, each inner gas diffusion layer has a thickness of 0.5 mm or less. In some embodiments, the inner gas diffusion layer has a thickness of 0.1-0.4 mm. In some embodiments, the inner gas diffusion layer has a thickness of 0.15-0.25 mm.

Figure 2B:
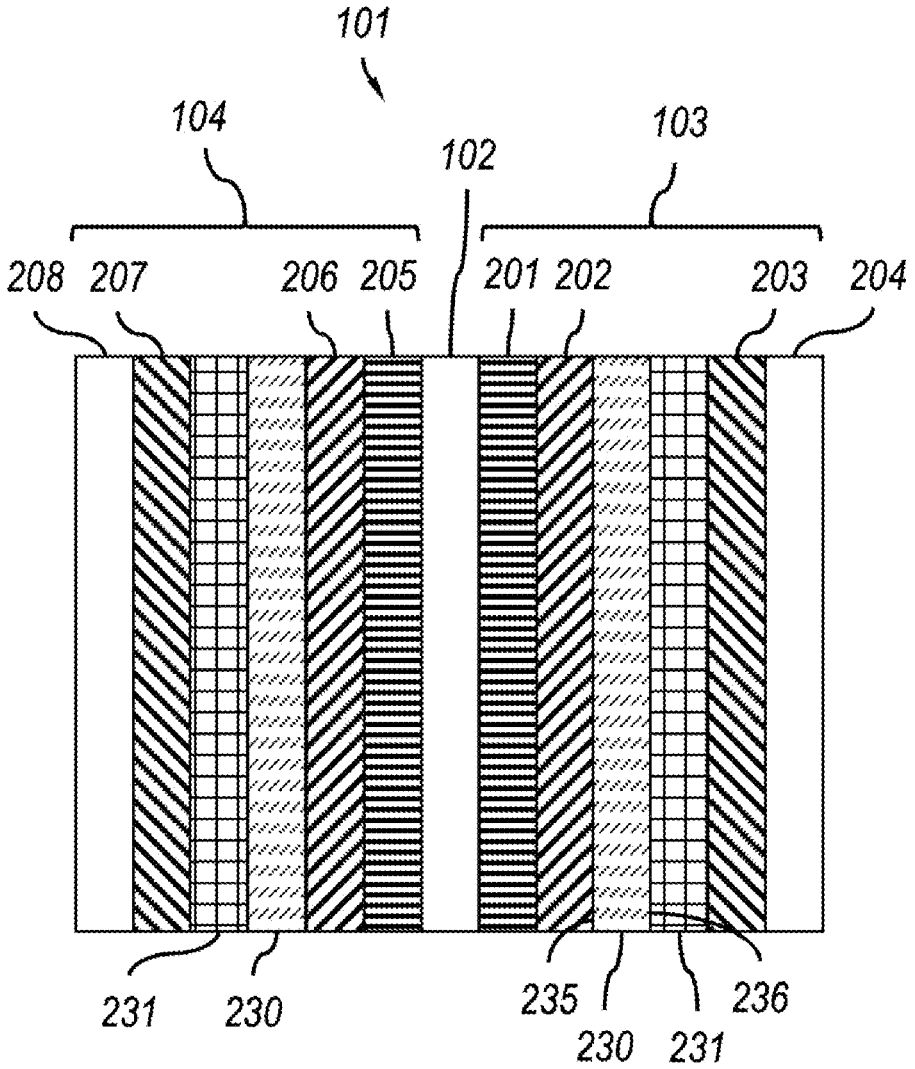

Referring to FIG. 2B, the anode portion 103 of each MEA may include one or more intermediate gas diffusion layers 230, 231 between the inner gas diffusion layer and the outer gas diffusion layer. The pore sizes of each intermediate gas diffusion layer should be selected so as to form a gradient of increasing pore sizes from the inner gas diffusion layer to the outer gas diffusion layer. Each intermediate gas diffusion layer 230 may have a first surface 235 facing the inner gas diffusion layer and a second surface 236 (opposite the first surface) facing the outer gas diffusion layer. Each intermediate gas diffusion layer 230 may having a pore size larger than a pore size of an adjacent diffusion layer coupled to the first surface (here, for example, inner gas diffusion layer 202) and smaller than a pore size of an adjacent diffusion layer coupled to the second surface (here, for example, a second intermediate gas diffusion layer 231).

In some embodiments, each intermediate gas diffusion layer has a thickness of 0.6 mm or less. In some embodiments, each intermediate gas diffusion layer has a thickness of 0.1-0.5 mm. In some embodiments, each intermediate gas diffusion layer has a thickness of 0.4-0.5 mm.

In some embodiments, each outer gas diffusion layer and any intermediate gas diffusion layers are made of porous metal or porous alloy that are configured to provide electronic conductivity for promoting electronic transfer. In some embodiments, each outer gas diffusion layer and any intermediate gas diffusion layer are treated with a fluoropolymer to enhance gas transport by converting a hydrophilic property of the porous metal or porous alloy to a hydrophobic property.

In some embodiments, the inner gas diffusion layer is more resistant to chemical corrosion than the outer gas diffusion layer and any intermediate gas diffusion layer.

Referring to FIG. 2A, the anode portion 103 of each MEA may include an anode catalyst layer 201 coupled to the first inner gas diffusion layer. The anode catalyst layer may comprise an anode catalyst.

In some embodiments, the anode catalyst may include nano particles of alloyed Ru, Rh, Pd, Ir, Pt, or their oxides. In some embodiments, the anode catalyst may be a core-shell catalyst. In some embodiments, the anode catalyst may include a PtRuOx core shell catalyst, containing PrRu core and their oxide shell.

In some embodiments, the anode portion comprises non-noble metal catalysts, such as NiOx, FeNiOx, CoNiOx, etc.

Referring to FIG. 2A, each MEA may include an alkaline electrolyte membrane (AEM) 102 coupled to the anode catalyst layer.

Any appropriate alkaline electrolyte membranes known to those of skill in the art may be utilized.

In some embodiments, anion exchange membranes offered under tradenames such as 2259-60 (Pall RAI), AHA by Tokuyama Co, Fumasep® FAA-(fumatech GmbH), Sustanion®, Morgane ADP by Solvay, or Tosflex® SF-17 by Tosoh may be utilized. In In some embodiments, polymers include HNN5/HNN8 by Ionomr, TM1 by Orion, and PAP-TP by W7energy may be utilized.

In some embodiments, the AEM may be a PK-reinforced membrane, such as Fumasep® FAA-3-PK-75 offered by fumatech GmbH.

It should be noted that in some embodiments, each inner gas diffusion layer may have one or two specific interfaces. In some embodiments, each inner gas diffusion layer may have a first interface 298 for coupling to the AEM, wherein the first interface is coated with the anode catalyst layer (if in the anode portion of the MEA) or the cathode catalyst layer (if in the cathode portion of the MEA). In some embodiments, each inner gas diffusion layer may have a second interface 299 for coupling to the outer gas diffusion layer or an intermediate gas diffusion layer, the interface being configured to allow for gas transport and electronic conductivity for electronic transfer.

Referring to FIG. 2A, the cathode portion 104 of each MEA may include a cathode catalyst layer 205 coupled to the AEM. The cathode catalyst layer may comprise a cathode catalyst. In some embodiments, the cathode catalyst may include particles of Ru, Rh, Pd, Ir, Pt, or a combination thereof. In some embodiments, the cathode catalyst may be a core-shell catalyst. In some embodiments, the anode catalyst may include a PtRuOs core shell catalyst.

In some embodiments, the cathode portion comprises non-noble metal catalysts.

In some embodiments, the cathode catalyst may be the same as the anode catalyst. In some embodiments, both the cathode catalyst and the anode catalyst may include non-noble metal catalysts. In some embodiments, both the cathode catalyst and the anode catalyst may include a PtRuOx core shell catalyst.

Referring to FIG. 2A, the cathode portion 104 of each MEA may include a second inner gas diffusion layer 206 coupled to the cathode catalyst layer. The second inner gas diffusion layer may be configured similar to the first inner gas diffusion layer as disclosed herein. In some embodiments, the second inner gas diffusion layer is identical to the first inner gas diffusion layer. In some embodiments, the second inner gas diffusion layer is different from the first inner gas diffusion layer.

Referring to FIG. 2A, the cathode portion 104 of each MEA may include a second outer gas diffusion layer 207 coupled to second inner gas diffusion layer. The second outer gas diffusion layer may be configured similar to the first outer gas diffusion layer as disclosed herein. In some embodiments, the second outer gas diffusion layer is identical to the first outer gas diffusion layer. In some embodiments, the second outer gas diffusion layer is different from the first outer gas diffusion layer.

Referring to FIG. 2A, the cathode portion 104 of each MEA may include a second current collector 208 coupled to second outer gas diffusion layer. The current collector may be configured similar to the first current collector as disclosed herein. In some embodiments, the second current collector is identical to the first current collector. In some embodiments, the second current collector is different from the first current collector.

Referring to FIG. 1A, each device may include a first internal water-gas separator 105. Each internal water-gas separator may have walls 109 with an internal surface 116 defining an internal volume of space 117. The internal volume of space is configured to be partially filled with a liquid 111, 113, with headspace 112, 118 available in the internal volume of space above the liquid.

The walls may define ports 114, 115 through each internal water-gas separator. Each port may be coupled to the internal volume of space. In some embodiments, one port 114 is configured to allow access to the liquid, while a second port 115 is configured to allow access to the headspace 112, 118.

Figure 1B:
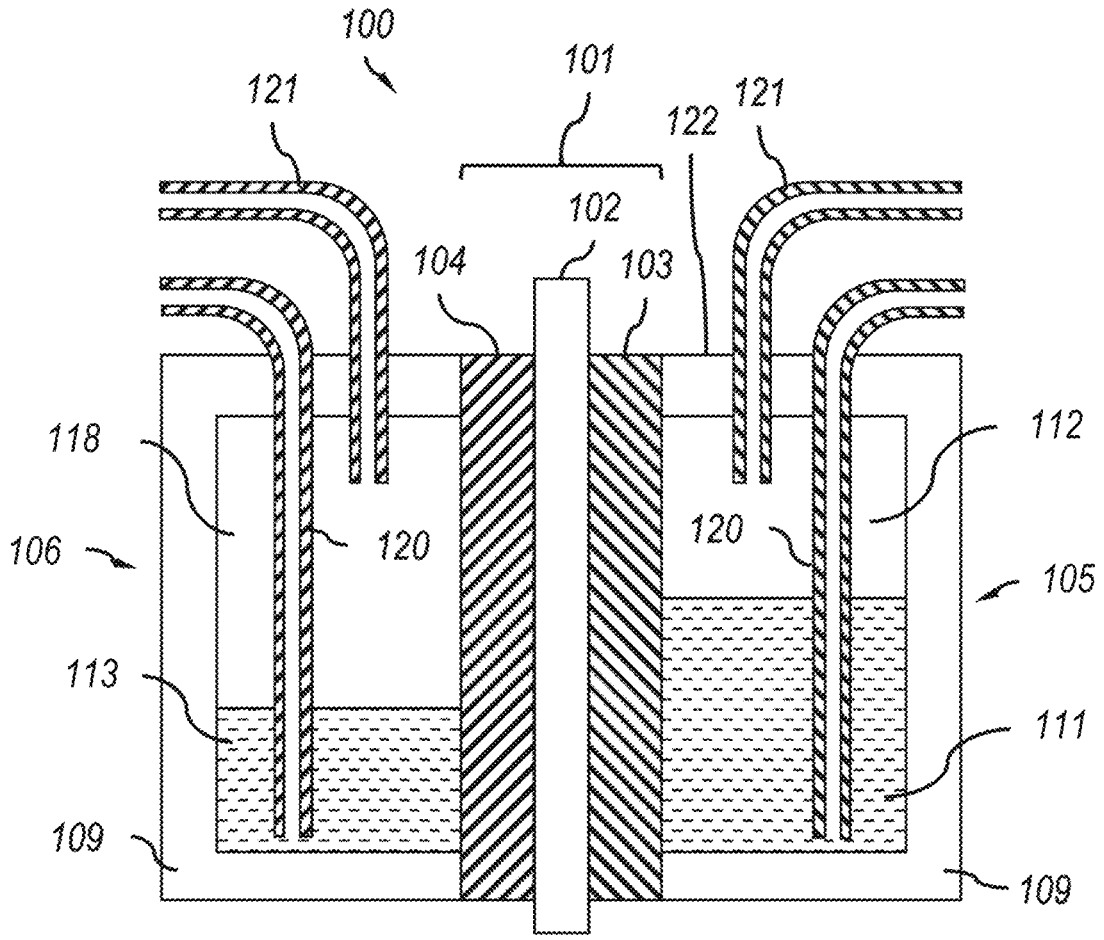

Referring to FIG. 1B, in some embodiments, each internal water-gas separator may include at least two tubes 120, 121. In some embodiments, each internal water-gas separator may include a first tube 120 may extend through a first port of the internal water-gas separator. The first tube may be configured to allow the liquid to be provided to the internal volume of space. In some embodiments, each internal water-gas separator may include a second tube 121 extending through a second port of the internal water-gas separator and configured to allow a gas present in a headspace of the internal volume to exit the internal water-gas separator without removing any liquid from the internal volume of space. In some embodiments, the first and second tubes pass through the same surface of internal water-gas separator (e.g., as shown here, both tubes through a top surface 122). In some embodiments, the first and second tubes pass through different surfaces of the internal water-gas separator (e.g., one through a top surface, one through a bottom surface). In some embodiments, the first tube may extend into the liquid portion. In some embodiments, the first tube may extend to the bottom of the internal volume of space.

In some embodiments, the liquid in the first internal volume of space is a first liquid. In some embodiments, the first internal volume of space is 40-60% full of the first liquid.

The first internal water-gas separator may be coupled to the first current collector, such that the first liquid is in contact with the first current collector and can flow into at least one of the plurality of openings in the first current collector.

The liquid in the internal volume of space may include water, an electrolyte, or both. In some embodiments, the first liquid comprises an electrolyte. In some embodiments, the electrolyte is an alkaline base, such as KOH or NaOH. In some embodiments, the first liquid is a solution comprising the electrolyte. In some embodiments, the first liquid is a solution of KOH or NaOH in water. In some embodiments, the concentration of the electrolyte is at least 0.1M or more.

In some embodiments, higher concentrations may lead to crystallization and/or a lack of stability. Therefore, in some embodiments, the concentration of the electrolyte is no more than 1M.

Referring to FIG. 1A, each device may include a second internal water-gas separator 106. The second internal water-gas separator has walls that define a second internal volume of space configured to be partially filled with a liquid. Aside from the positioning of the device, the second internal water-gas separator is constructed similar to the first internal water-gas separator.

In some embodiments, the liquid in the second internal volume of space is a second liquid. In some embodiments, the second internal volume of space is 20-40% full of the second liquid.

The second internal water-gas separator may be coupled to the second current collector, such that the second liquid is in contact with the second current collector and can flow into at least one of the plurality of openings in the second current collector.

The liquid in the second internal volume of space may include water, an electrolyte, or both. In some embodiments, the second liquid comprises an electrolyte. In some embodiments, the electrolyte is an alkaline base, such as KOH or NaOH. In some embodiments, the second liquid is a solution comprising the electrolyte. In some embodiments, the second liquid is a solution of KOH or NaOH in water. In some embodiments, the concentration of the electrolyte is at least 0.1M.

In some embodiments, the first liquid and the second liquid are identical.

Figure 3:
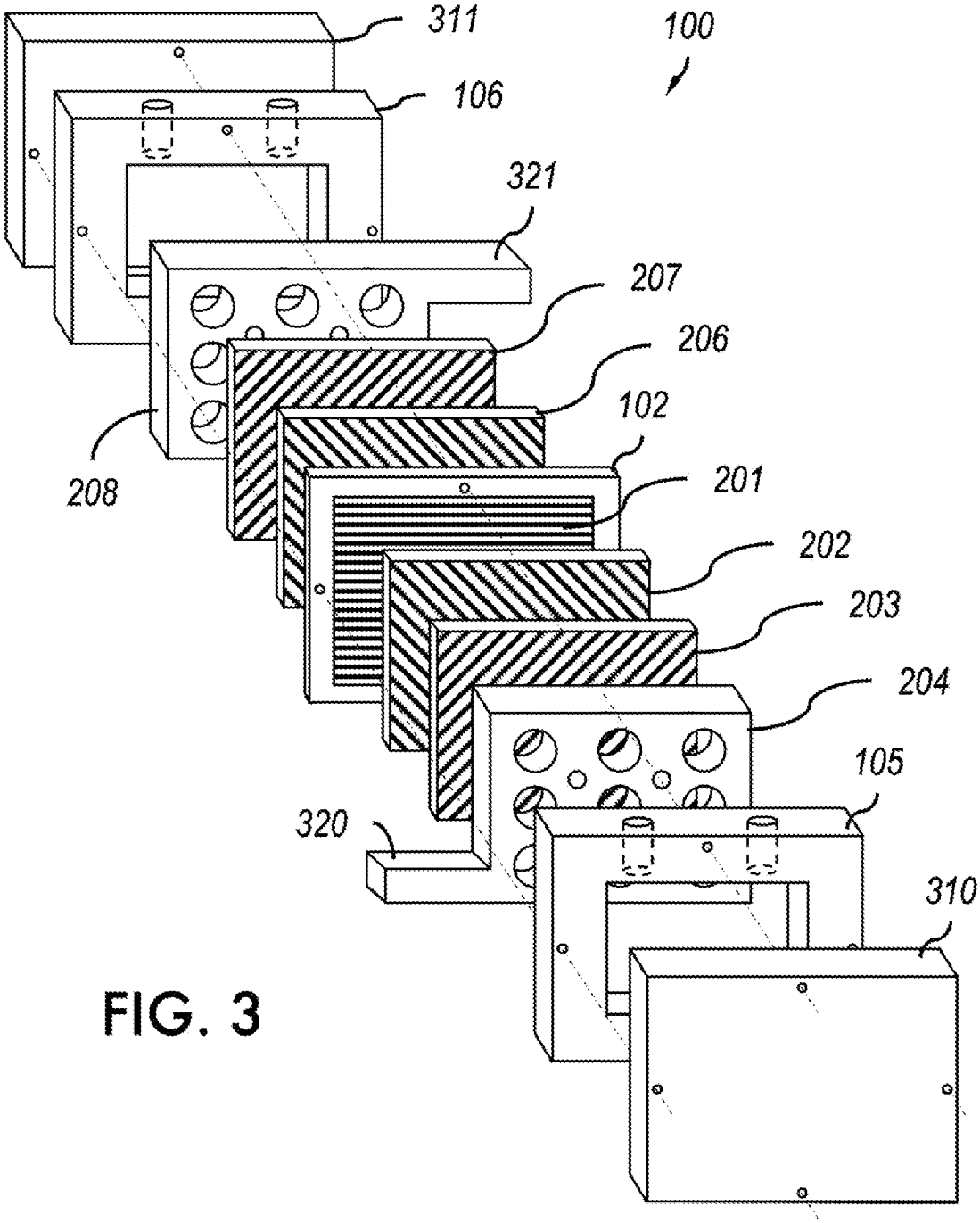
FIG. 3 is an exploded via of a single cell water electrolytic device.

Referring to FIG. 3, an exploded view of a water electrolytic device can be seen. As shown, the dashed lines represent, e.g., screw assembling lines through outer on the parts. As seen, the device may be capped with a non-porous substrate 310, 311 (which may be, e.g., transparent polymer blocks for monitoring liquid levels in the internal water-gas separators 105, 106) coupled to an outward-facing surface of each internal water-gas separator 105, 106. As seen, liquid in the internal water-gas separators will be intimately in contact with the current collectors 204, 208.

Figure 4:
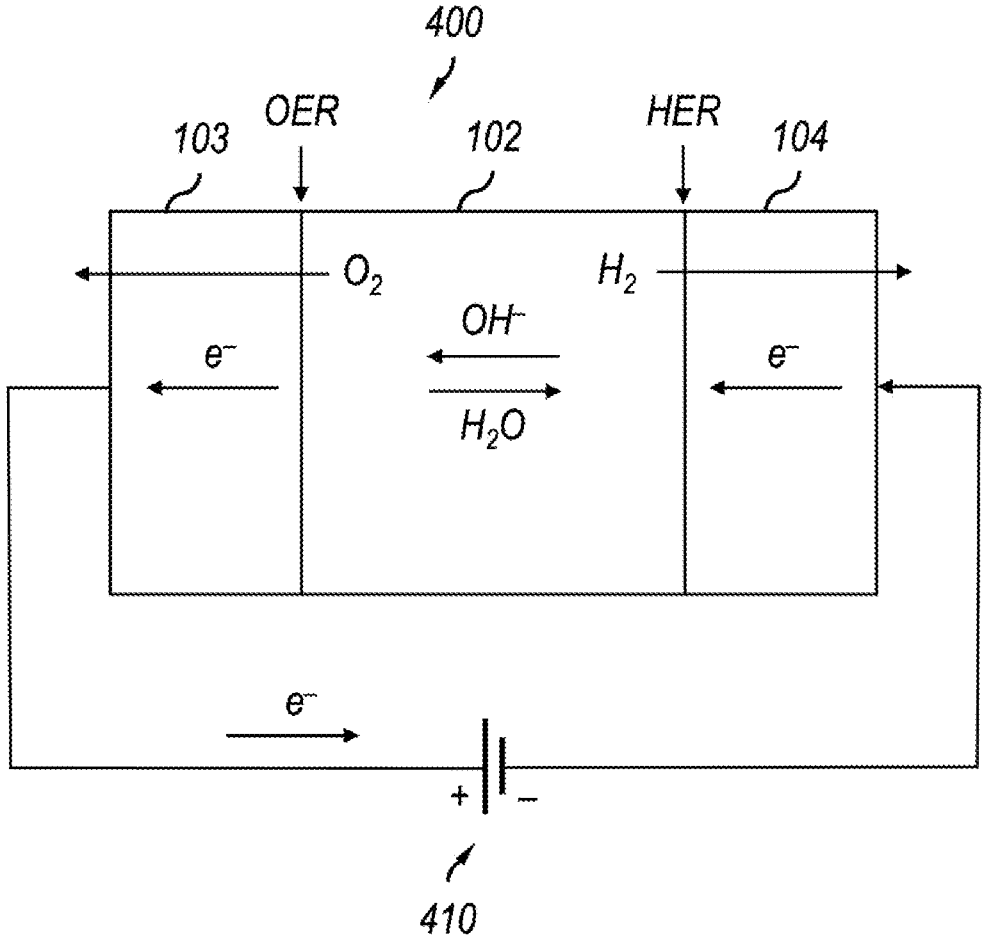
FIG. 4 is a schematic view of electrical wiring of a single cell electrolytic device, showing the flux of electrons, ions, and water, hydrogen gas and oxygen gas.

The current collectors 204, 208 are shown having leads 320, 321, to allow current to be applied across the MEA. As shown in FIG. 4, a cell 400 (such as a single MEA consisting of a cathode portion 104, an anode portion 103, and a AEM 102) may be connected to a power source 410 via electrical wiring. FIG. 4 shows a schematic view of electrically wiring a single cell electrolytic device, and the flux of electrons, ions, and water, hydrogen gas and oxygen gas. The oxygen and water are generated at the anode/membrane interface (note the oxygen evolution reaction (OER) shown as occurring at the interface between the anode portion 103 and the AEM 102). The hydrogen and hydroxide ions ($OH^-$) are generated at the cathode/membrane interface (note the hydrogen evolution reaction (HER) shown as occurring at the interface between the AEM 102 and the cathode portion 104). Hydroxide ions flux from the cathode to the anode. The electrons then flow from the anode to the cathode through an external wire.

The advantages of the present disclosed electrolytic device may be further extended by designing and building a multi-cell AEM electrolytic device. The disclosed devices will have n cells or MEAS, and n+1 internal water-gas separators.

Figure 5:
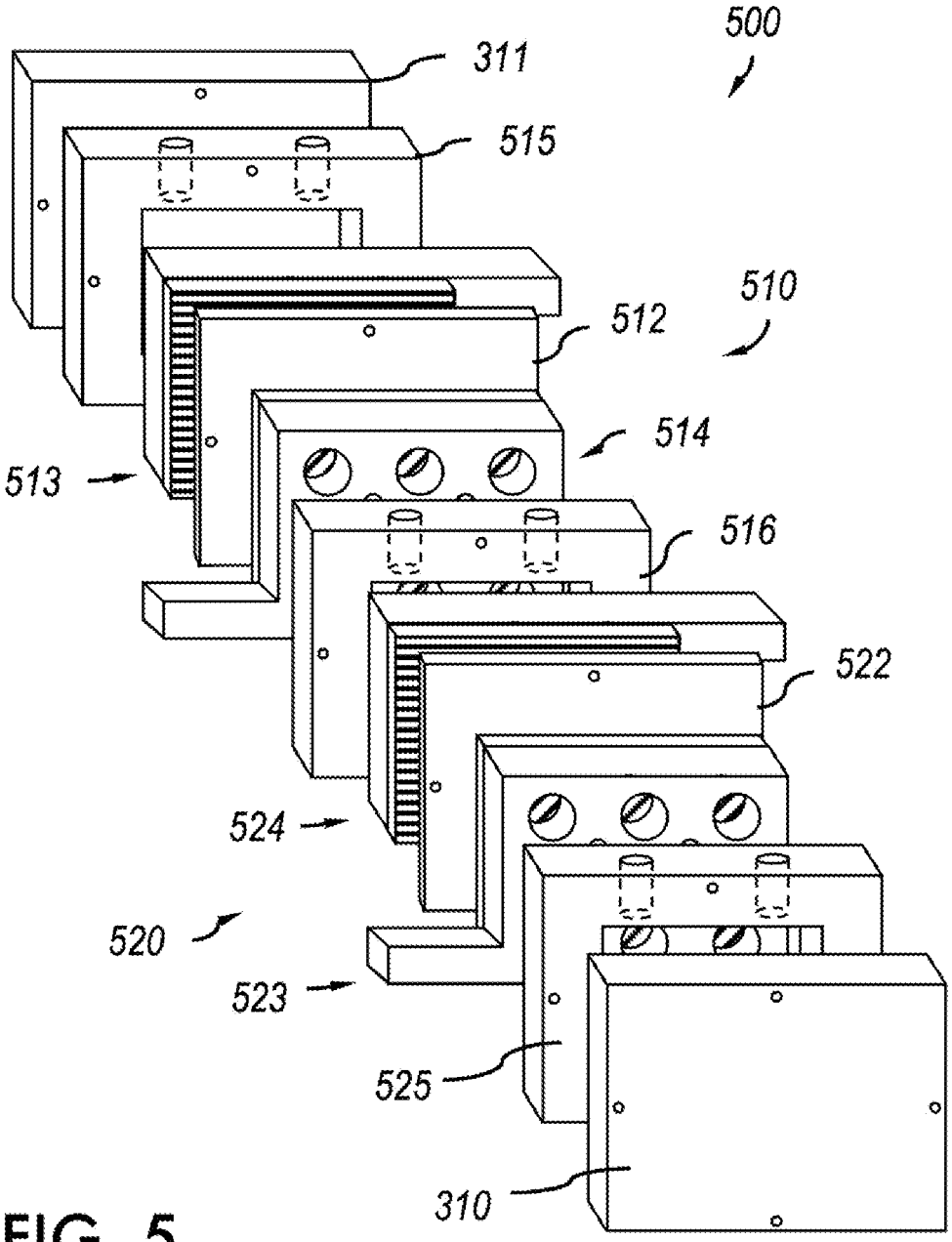
FIG. 5 is an exploded view of a bi-cell electrolytic device, where the two cells share one internal water gas separator for hydrogen generation.

FIG. 5 shows an exploded view of, e.g., a bi-cell electrolytic device, where the two cells share one internal water gas separator for hydrogen generation. As seen in FIG. 5, the device 500 includes two cells 510, 520. Each cell has an anode portion 513, 523, an AEM 512, 522, and a cathode portion 514, 524. Just like a single-cell device, the first cell has a first internal water-gas separator 515 coupled to an anode portion 513, an AEM 512 coupled to the anode portion, a cathode portion 514 coupled to the AEM, and a second internal water-gas separator 516 coupled to the cathode portion. However, adding a second cell 520 does not require adding two internal water-gas separators. The second internal water-gas separator 516 is shared by the cathode portion 514 of the first cell and the cathode portion 524 of the second cell. Specifically, as disclosed herein, the second internal water-gas separator is coupled to the current collector in the cathode portion of the second cell, just as it is for the first cell. Note, the device could readily be arranged where anodes shared a single internal water-gas separator. Here, the second cell also include an AEM 522 coupled to the cathode portion, an anode portion 523 coupled to the AEM, and a third internal water-gas separator 525 coupled to the cathode portion. Specifically, as disclosed herein, the third internal water-gas separator is coupled to the current collector in the anode portion.

Figure 6A:
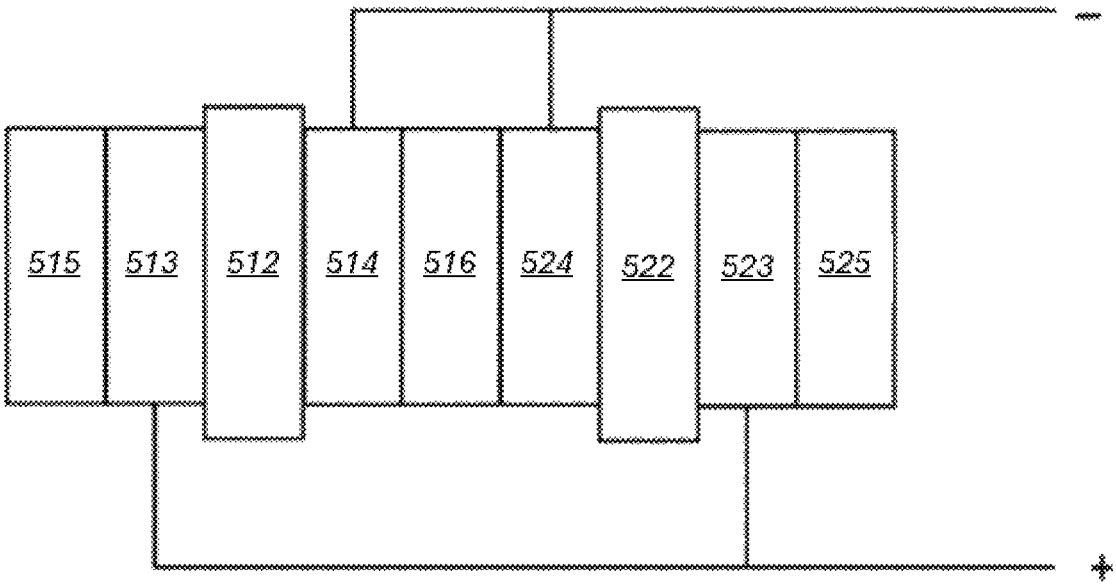
FIGS. 6A and 6B are schematic views of electrical wiring of a bi-cell electrolytic device in parallel (6A) and series (6B).
Figure 6B:
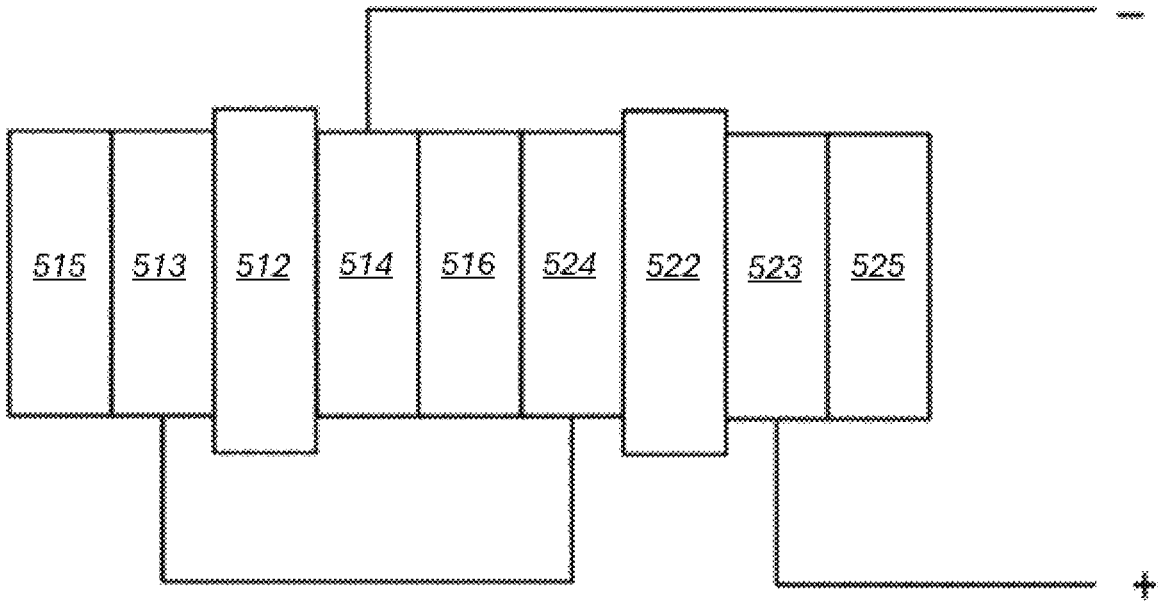

The multi-cell devices may be configured serially and/or in parallel. As shown in FIG. 6A, in some embodiments, the cells are wired in parallel. By utilizing parallel electric connections, the current density will be doubled (for a bi-cell device) and so will the hydrogen production. Parallel connections simplify the system and make it easier to control the electrochemical reactions in the device. Referring to FIG. 6B, in some embodiments, the cells are wired in series. In this configuration, the series electric connection will not double the current density but will instead double the voltage (for a bi-cell device). This will reduce the overall current density, and therefore, reduces the IR drops by wiring.

Figure 7:
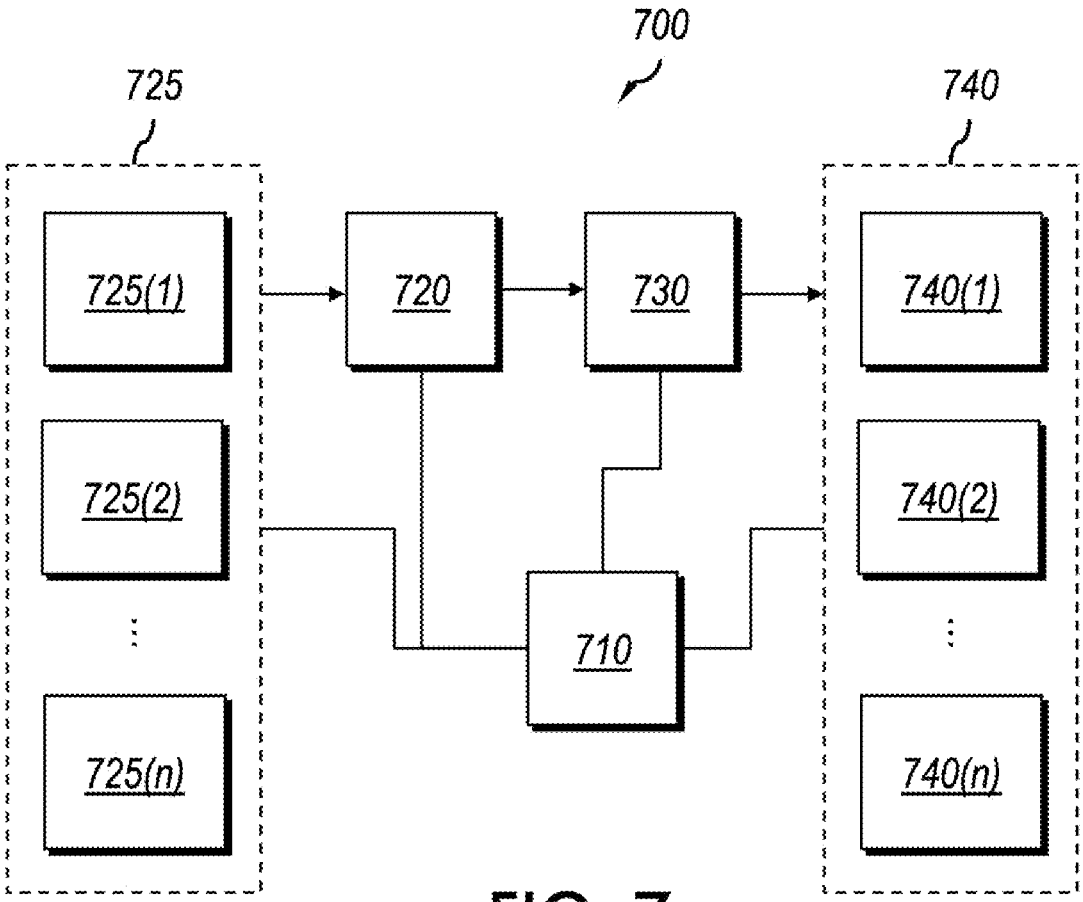
FIG. 7 is a block diagram of a system utilizing a water electrolytic device.

Referring to FIG. 7, a simplified system 700 can be seen. The system may include a water electrolytic device 720 as disclosed herein. One or more controllers 710 may be operably coupled to the electrolytic device. The controller(s) may include one or more processors (not shown). The controller(s) may be configured to function as a DC power supply for the electrolytic device.

In some embodiments, a plurality of liquid sources 725 are provided, which includes liquid sources 725(1), 725(2), . . . , 725(*n*). In some embodiments, each internal water-gas separator may have a liquid source operably coupled to it (e.g., through a tube 120 as shown in FIG. 1B). The source may have one or more valves controlled by the controller(s) 710. In some embodiments, only a single liquid source is provided, and is coupled to each internal water-gas separator.

In some embodiments, the hydrogen generated by the water electrolytic device is sent to a remote device 730, which is configured to receive hydrogen from the water electrolytic device. In some embodiments, this is a storage container. In some embodiments, this may be a reaction chamber for reacting with other materials. In some embodiments, this is a fuel cell. This remote device may be coupled by a controller(s) 710.

In some embodiments, a fuel cell may be operably coupled to one or more additional devices 740 (including devices 740(1), 740(2), . . . , 740(*n*)). These devices may be configured to utilize the electricity generated by the fuel cell.

As will be understood by those of skill in the art, the disclosed device may also be used with appropriate ancillary equipment, such as those typically found in balance of plant (BoP) systems, e.g., for hydrogen generation, and/or application in fuel cells. Such additional equipment may include, but are not limited to, standard components for electrical BoP (transformers, circuit breakers, switches, etc.) and/or mechanical BoP (fuel conditioning/filtering, pressure control, fire suppression, etc.), which may be readily utilized with the disclosed device.

EXAMPLES

A catalyst was prepared by heat-treatment of commercial 50% PtRu, which was purchased from Johnson Matthey, at 250° C. in a tubular furnace for ~20 hours in air environmental to form PtRuOx core shell catalyst containing PtRu core and surface metal oxide layer. The PtRuOx can be used as the anode catalyst for oxygen evolution reaction, and for cathode catalyst for hydrogen evolution reaction evolution. Therefore, the AEM electrolytic device is simplified by only using a single catalyst. The catalyst ink was prepared by weighing ~0.08 g PtRuOx, and ~0.09 g graphene nanoplatelets (or GNP, with a BET surface area between 600-650 $m^2/g$) were purchased from Cheap Tubes Inc.), and mixed in a plastic vial containing 1.5 ml water and 1.5 ml alcohol, and followed ultrasonically treated with a Branson Sonifier 450 at a duty cycle 40 and output control 4 for 20 minutes, cooled by ice water bath. The ink was further mixed with 0.049 g 10% Fumion dispersion FAA-3 solute (purchased from Fuel Cell store, it is an anion exchange ionomer, used as a binder). The ink was coated on 4 pieces of 9 $cm^2$ wet proof Toray carbon paper (0.19 mm thick) by gently warming up. The MEA was prepared by sandwiching two pieces of catalyst coated carbon papers and one alkaline electrolyte membrane (thickness 80 μm, Fumasep FAA-3-PK-75, purchased from Fuel Cell store). The MEA was hot-pressed at 70° C. 500 psi for ~10 minutes. The water electrolytic device was assembled by sandwiching one or two MEAS, carbon papers, Teflon-treated nickel foams (the Teflon being used to change the nickel foam's hydrophilic property to a hydrophobic property), current collectors and hollowed plastic glass together, in the methods as disclosed herein (see, e.g., FIGS. 3, 5). The current collector was made with titanium sheet with thickness 0.6 mm. The water electrolytic device was tested at room temperature (~20° C.), with a Keysight E3633 DC Power Supply and an Agilent 34401A Multimeter. The electrolyte was 1M KOH, which was filled into the anode water gas separator in 40-60% of its content (~3-5 ml), and the cathode water gas separator in 20-40% of its content (1.5-3.0 ml). The device was operated by applying electric power from zero volt to 2.2V for a single cell device, then the voltage was held at 2.2V until the current became stable (~ a couple of hours). Data were taken after the AEM electrolytic device became stable.

Example 1

Figure 8A:
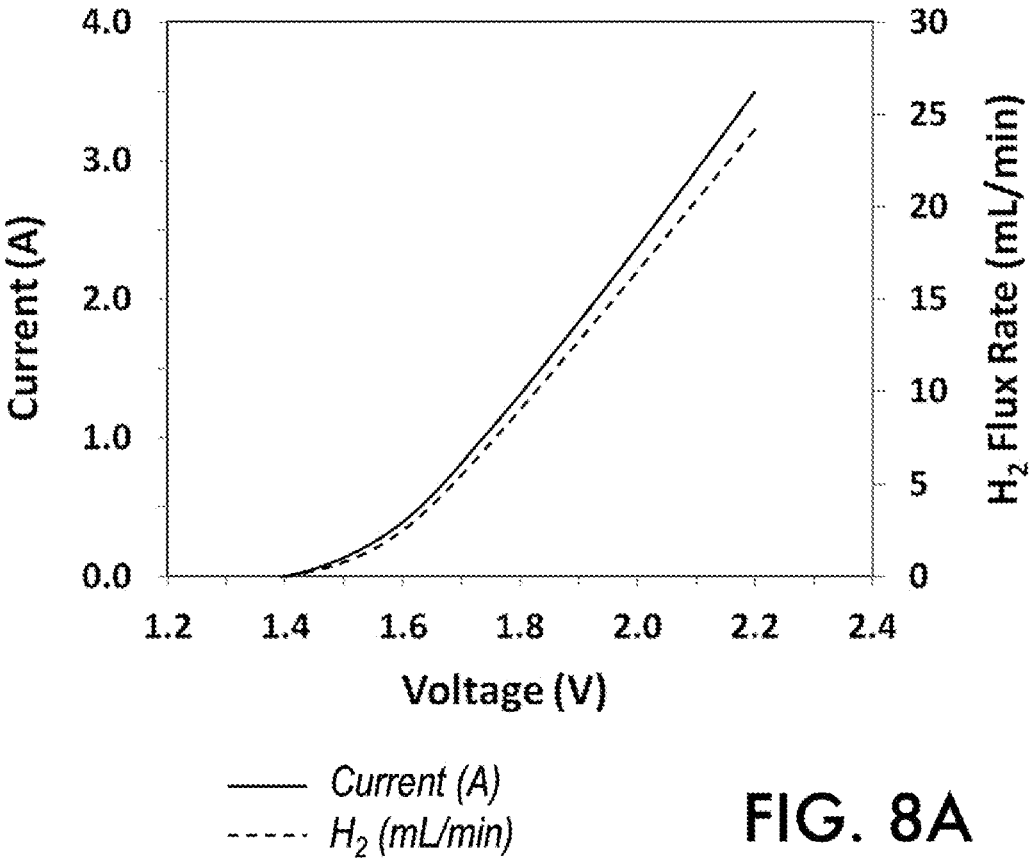
FIG. 8A is a graph showing test results of a single cell electrolytic device for hydrogen generation.

A single cell electrolytic device was tested by adding 4 ml 1.0M KOH in each of the water gas separators, the hydrogen gas was let out with a plastic tube from the top of the chamber facing the cathode electrode. After the current became stable at 2.2V, the data were taken from 2.2V to 1.4V with interval 0.1V. FIG. 8A shows test results of a single cell electrolytic device for hydrogen generation. The hydrogen gas flux rate reached up to 25 ml/min.

Example 2

Figure 8B:
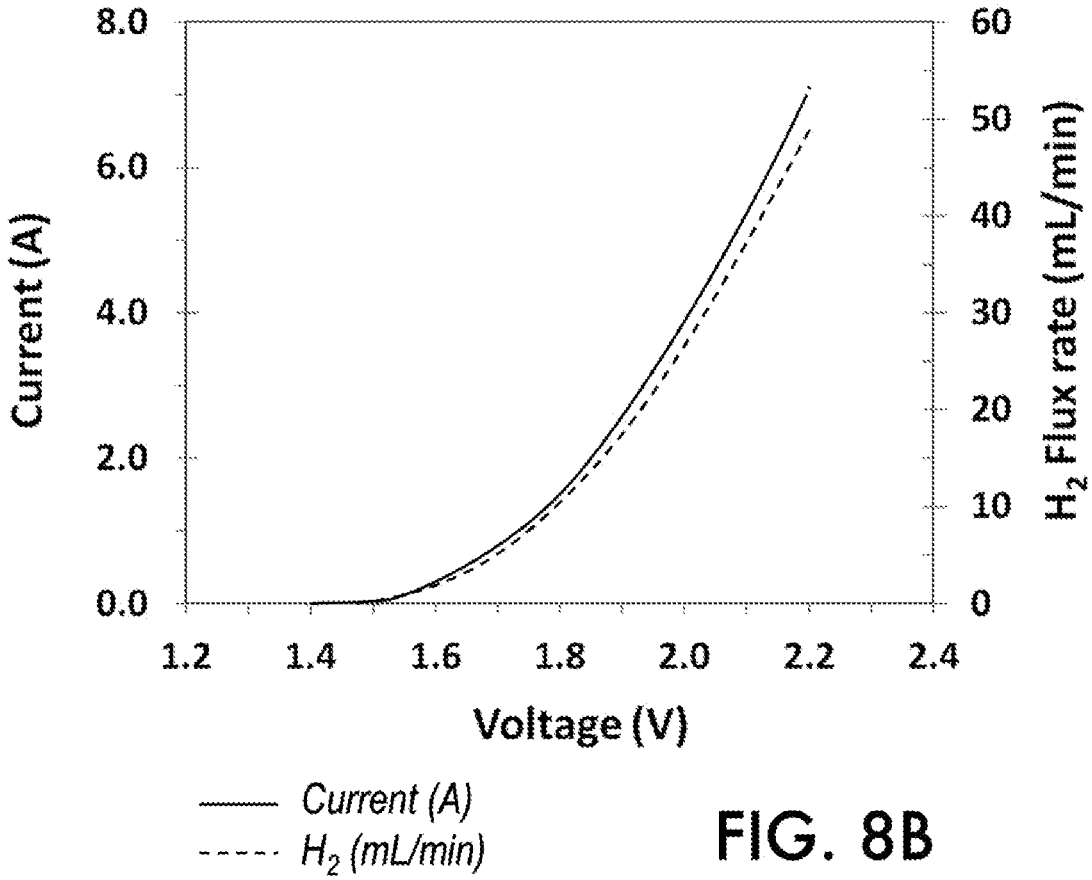
FIG. 8B is a graph showing test results of a bi-cell electrolytic device for hydrogen generation, electrically connected by parallel.

A bi-cell electrolytic device connected in parallel was tested by adding 4 ml 1.0M KOH in each of the water gas separators, the hydrogen gas was let out with a plastic tube from the top of the central chamber that is facing two cathode electrodes belonging to two separated cells. After the current became stable at 2.2V, the data were taken from 2.2V to 1.4V with interval 0.1V. FIG. 8B shows test results of a bi-cell electrolytic device connected in parallel for hydrogen generation. The hydrogen gas flux rate reached up to 50 ml/min.

Example 3

Figure 8C:
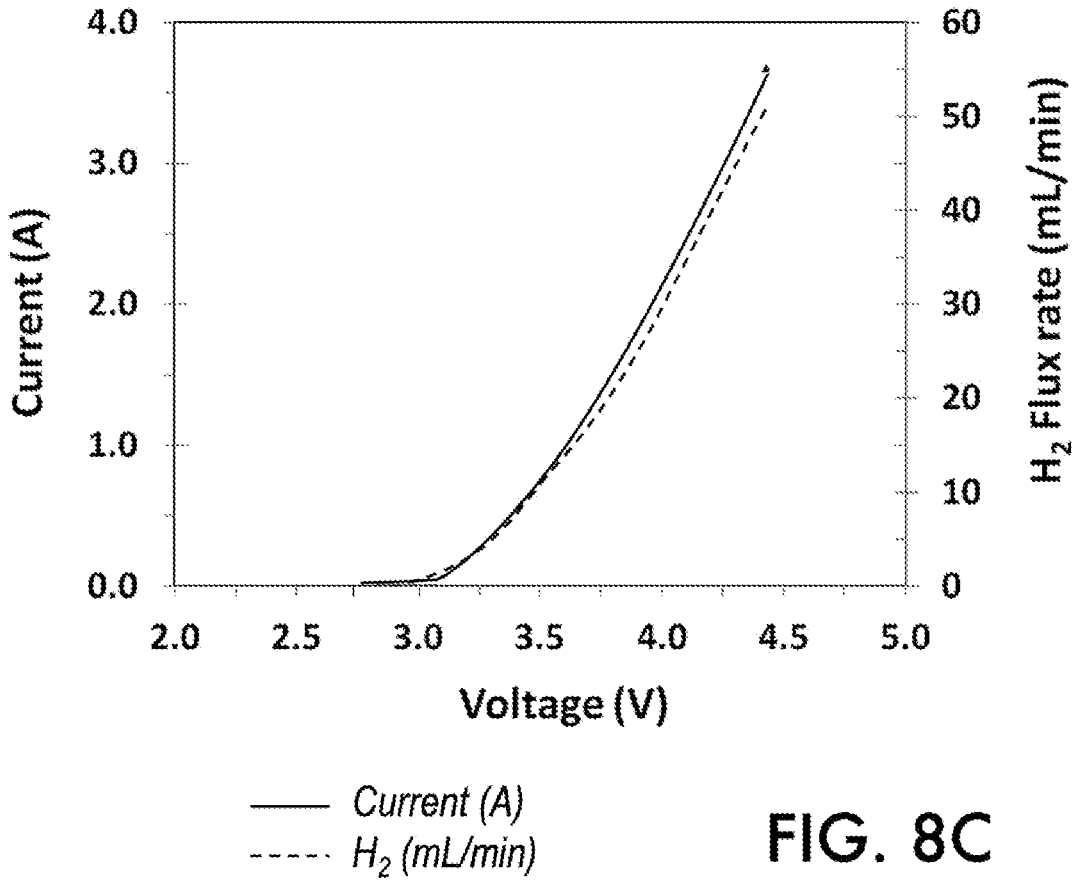
FIG. 8C is a graph showing test results of a bi-cell electrolytic device for hydrogen generation, electrically connected by series.

A bi-cell electrolytic device connected in series was tested by adding 4 ml 1.0M KOH in each of the water gas separators, the hydrogen gas was let out with a plastic tube from the top of the central chamber that is facing two cathode electrodes belonging to two separated cells. After the current became stable at ~4.4V, the data were taken from 4.4V to 2.4V with interval ~0.1V. FIG. 8C shows test results of a bi-cell electrolytic device connected in series for hydrogen generation. The hydrogen gas flux rate reached up to 51 ml/min.

Example 4

The hydrogen gas produced from a single cell electrolytic device was examined by leading out to fill into an air breathing fuel cell system, and the fuel cell powering a LED light. The LED was lit at ~2.4 watt (~0.6 A, 4V).

Example 5

A bi-cell electrolytic device as disclosed herein was manufactured, with a 9 $cm^2$ active electrode area. The hydrogen flux reached to ~50 ml/min.

While the invention is described through the above-described exemplary embodiments, modifications to, and variations of, the illustrated embodiments may be made without departing from the inventive concepts disclosed herein. For example, although specific parameter values, such as dimensions and materials, may be recited in relation to disclosed embodiments, within the scope of the invention, the values of all parameters may vary over wide ranges to suit different applications.

As used herein, including in the claims, the term "and/or," used in connection with a list of items, means one or more of the items in the list, i.e., at least one of the items in the list, but not necessarily all the items in the list.

Disclosed aspects, or portions thereof, may be combined in ways not listed above and/or not explicitly claimed. In addition, embodiments disclosed herein may be suitably practiced, absent any element that is not specifically disclosed herein. Accordingly, the invention should not be viewed as being limited to the disclosed embodiments.

What is claimed is:

1. A water electrolytic device for generating oxygen and hydrogen gases through electrolysis of water, comprising:

at least one membrane electrode assembly (MEA), including a first MEA, in contact with water, each MEA including:

a first current collector having a first surface defining a first plurality of openings extending from the first surface to a second surface opposite the first surface;

a first outer gas diffusion layer coupled to the first current collector;

a first inner gas diffusion layer coupled to the first outer gas diffusion layer, wherein oxygen gas diffuses through the first inner gas diffusion layer and into the first outer gas diffusion layer;

an anode catalyst layer coupled to the first inner gas diffusion layer, the anode catalyst layer comprising an anode catalyst;

an alkaline electrolyte membrane (AEM) coupled to the anode catalyst layer;

a cathode catalyst layer coupled to the AEM;

a second inner gas diffusion layer coupled to the cathode catalyst layer, the cathode catalyst layer comprising a cathode catalyst;

a second outer gas diffusion layer coupled to the second inner gas diffusion layer, wherein hydrogen gas diffuses through the second inner gas diffusion layer and into the second outer gas diffusion layer; and a second current collector coupled to the second outer gas diffusion layer, the second current collector having a first surface defining a second plurality of openings extending from the first surface to a second surface opposite the first surface;

a first internal water-gas separator forming a first reservoir having walls defining a first internal volume of space configured to be at least partially filled with a first liquid, the first internal water-gas separator being externally coupled to the first current collector so that the first liquid is maintained in intimate contact with the first current collector during operation; and a second internal water-gas separator forming a second reservoir having walls defining a second internal volume of space configured to be at least partially filled with a second liquid, the second internal water-gas separator being externally coupled to the second current collector so that the second liquid is maintained in intimate contact with the second current collector during operation, wherein the first and second inner gas diffusion layers and the first and second outer gas diffusion layers each have a pore size with the pore sizes of the inner gas diffusion layers being smaller than the pore sizes of the outer gas diffusion layers such that the pore size increases as gas diffuses through the inner and outer diffusion layers with the largest pore size being closest to the first and second reservoirs, wherein each of the first and second inner gas diffusion layer has a pore size of 10-60 μm, and each of the first and second outer gas diffusion layer has a pore size of 300-600 μm.

2. The water electrolytic device according to claim 1, wherein the first internal volume of space is 40-60% full of the first liquid; and wherein the second internal volume of space is 20-40% full of the second liquid.

3. The water electrolytic device according to claim 1, wherein each of the first and second current collectors comprises a non-corrosive metal sheet having a thickness of 0.6-1.0 mm, the first plurality of openings having a first diameter and the second plurality of openings having a second diameter, where the second diameter is larger than the first diameter.

4. The water electrolytic device according to claim 3, wherein the first diameter is 1.6 mm, and the second diameter is 3.3 mm.

5. The water electrolytic device according to claim 3, wherein each of the first and second inner gas diffusion layers has a first mean pore size, and each of the first and second outer gas diffusion layers has a second mean pore size, wherein the second mean pore size is larger than the first mean pore size, and second mean pore size is smaller than the first diameter.

6. The water electrolytic device according to claim 5, further comprising one or more intermediate gas diffusion layers between the inner gas diffusion layer and the outer gas diffusion layer, each intermediate gas diffusion layer have a first side facing the inner gas diffusion layer and a second surface facing the outer gas diffusion layer, each intermediate gas diffusion layer having a pore size larger than a pore size of an adjacent diffusion layer coupled to the first surface, and smaller than a pore size of an adjacent diffusion layer coupled to the second surface.

7. The water electrolytic device according to claim 3, wherein the non-corrosive metal sheet comprises titanium.

8. The water electrolytic device according to claim 3, wherein the first liquid comprises water, an electrolyte, or both, and the second liquid comprises water, an electrolyte, or both.

9. The water electrolytic device according to claim 1, wherein each inner gas diffusion layer comprises hydrophobic carbon paper or hydrophobic carbon cloth, each inner gas diffusion layer having a first interface for coupling to the AEM, wherein the first interface is coated with the anode catalyst layer or the cathode catalyst layer.

10. The water electrolytic device according to claim 9, wherein each inner gas diffusion layer has a second interface for coupling to the outer gas diffusion layer or an intermediate gas diffusion layer, the interface being configured to allow for gas transport and electronic conductivity for electronic transfer.

11. The water electrolytic device according to claim 1, wherein each of the first and second outer gas diffusion layers and any intermediate gas diffusion layer are made of porous metal or porous alloy that are configured to provide electronic conductivity for promoting electronic transfer.

12. The water electrolytic device according to claim 11, wherein each of the first and second outer gas diffusion layers and any intermediate gas diffusion layer are treated with a fluoropolymer to enhance gas transport by converting a hydrophilic property of the porous metal or porous alloy to a hydrophobic property.

13. The water electrolytic device according to claim 1, wherein the cathode catalyst is different from the anode catalyst.

14. The water electrolytic device according to claim 1, wherein the cathode catalyst is the same as the anode catalyst.

15. The water electrolytic device according to claim 14, wherein the cathode catalyst and the anode catalyst comprises a PtRuOx core shell catalyst.

16. The water electrolytic device according to claim 1, wherein both the cathode catalyst and the anode catalyst comprise non-noble metal catalysts.

17. The water electrolytic device according to claim 1, wherein the first internal water-gas separator comprises at least two ports coupled to the first internal volume of space, and the second internal water-gas separator comprises at least two ports coupled to the second internal volume of space.

18. The water electrolytic device according to claim 17, further comprising:

a first tube extending through the first port of the first internal water-gas separator, configured to allow the first liquid to be provided to the first internal volume of space;

a second tube extending through the first port of the second internal water-gas separator, configured to allow the second liquid to be provided to the second internal volume of space;

a third tube extending through the second port of the first internal water-gas separator and configured to allow a gas present in a headspace of the first internal volume to exit the first internal water-gas separator without removing any first liquid; and a fourth tube extending through the second port of the second internal water-gas separator and configured to allow a gas present in a headspace of the second internal volume to exit the second internal water-gas separator without removing any second liquid.

19. The water electrolytic device according to claim 18, wherein the first tube extends to the bottom of the first internal volume of space, and wherein the second tube extends to the bottom of the second internal volume of space.

20. The water electrolytic device according to claim 1, wherein the at least one MEA includes a second MEA, the second current collector of the second MEA coupled to the second internal water-gas separator; and wherein the water electrolytic device further comprises a third internal water-gas separator coupled to the first current collector of the second MEA.

21. The water electrolytic device according to claim 20, wherein the first MEA and the second MEA are configured to be wired in parallel.

22. The water electrolytic device according to claim 20, wherein the first MEA and the second MEA are configured to be wired in series.

23. A system comprising:

a water electrolytic device according to claim 1; and a remote device configured to receive hydrogen from the water electrolytic device.

24. The system according to claim 23, wherein the remote device is a fuel cell or a storage container.

25. The water electrolytic device according to claim 1, wherein the first and second inner gas diffusion layers and the first and second outer gas diffusion layers each have an electrical conductivity with the electrical conductivities of the inner gas diffusion layers being smaller than the electrical conductivities of the outer gas diffusion layers such that the electrical conductivities increase as gas diffuses through the inner and outer diffusion layers.

26. The water electrolytic device according to claim 1, wherein the first and second inner gas diffusion layers each have a hydrophilic property and the first and second outer gas diffusion layers each have a hydrophobic property with the hydrophobicity increasing as gas diffuses through the inner and outer diffusion layers.

27. A pump-free water electrolytic device for generating oxygen and hydrogen gases through electrolysis of water, comprising:

at least one membrane electrode assembly (MEA), including a first MEA, in contact with water, each MEA including:

a first current collector having a first surface defining a first plurality of openings extending from the first surface to a second surface opposite the first surface;

a first outer gas diffusion layer coupled to the first current collector;

a first inner gas diffusion layer coupled to the first outer gas diffusion layer, wherein oxygen gas diffuses through the first inner gas diffusion layer and into the first outer gas diffusion layer;

an anode catalyst layer coupled to the first inner gas diffusion layer, the anode catalyst layer comprising an anode catalyst;

an alkaline electrolyte membrane (AEM) coupled to the anode catalyst layer;

a cathode catalyst layer coupled to the AEM;

a second inner gas diffusion layer coupled to the cathode catalyst layer, the cathode catalyst layer comprising a cathode catalyst;

a second outer gas diffusion layer coupled to the second inner gas diffusion layer, wherein hydrogen gas diffuses through the second inner gas diffusion layer and into the second outer gas diffusion layer; and a second current collector coupled to the second outer gas diffusion layer, the second current collector having a first surface defining a second plurality of openings extending from the first surface to a second surface opposite the first surface;

a first internal water-gas separator forming a first reservoir having walls defining a first internal volume of space configured to be at least partially filled with a first liquid, the first internal water-gas separator being externally coupled to the first current collector so that the first liquid is maintained in intimate contact with the first current collector during operation; and a second internal water-gas separator forming a second reservoir having walls defining a second internal volume of space configured to be at least partially filled with a second liquid, the second internal water-gas separator being externally coupled to the second current collector so that the second liquid is maintained in intimate contact with the second current collector during operation, wherein the first and second inner gas diffusion layers and the first and second outer gas diffusion layers each have a pore size with the pore sizes of the inner gas diffusion layers being smaller than the pore sizes of the outer gas diffusion layers such that the pore size increases as gas diffuses through the inner and outer diffusion layers with the largest pore size being closest to the first and second reservoirs, wherein each of the first and second inner gas diffusion layer has a pore size of 10-60 μm, and each of the first and second outer gas diffusion layer has a pore size of 300-600 μm, and wherein there is no pumping element to supply and/or circulate water and electrolyte to and/or from the anode and cathode catalyst layers in the device during operation.

* * * * *